US005718413A

United States Patent [19]

Nagler

[11] Patent Number: 5,718,413

[45] Date of Patent: Feb. 17, 1998

[54] SAFETY CUSHION

[76] Inventor: Yaacov Nagler, 7300 Pyle Rd., Bethesda, Md. 20817

[21] Appl. No.: 689,679

[22] Filed: Aug. 13, 1996

[51] Int. Cl.[6] ..... E01F 15/00

[52] U.S. Cl. ..... 256/13.1; 256/1; 404/6; 52/DIG. 9; 248/245.1; 206/593; 410/87; 410/117; 410/122; 410/155

[58] Field of Search ..... 256/13.1, 1; 404/6, 404/9, 10; 52/DIG. 9; 248/345.1; 206/593, 591; 410/117, 155, 121, 125, 87, 122

[56] References Cited

U.S. PATENT DOCUMENTS

| | | | |
|---|---|---|---|
| 2,032,511 | 9/1933 | Stevenson | 52/DIG. 9 X |
| 2,843,074 | 7/1958 | Norman | 293/102 |
| 3,661,359 | 5/1972 | Walker | 293/102 |
| 3,863,589 | 2/1975 | Guienne et al. | 293/102 |
| 3,928,701 | 12/1975 | Roehner | 404/6 X |
| 3,951,384 | 4/1976 | Hildreth, Jr. | 52/DIG. 9 X |
| 4,022,452 | 5/1977 | Dupre | 428/903.3 |
| 4,030,706 | 6/1977 | Ward | 256/13.1 X |
| 4,288,061 | 9/1981 | Moreau | 256/13.1 X |
| 5,193,692 | 3/1993 | Farley et al. | 211/41 |
| 5,238,228 | 8/1993 | Moon | 256/13.1 |
| 5,568,913 | 10/1996 | Nagler | 256/13.1 |
| 5,647,708 | 7/1997 | Letts, III | 410/125 X |

*Primary Examiner*—Kenneth J. Dorner
*Assistant Examiner*—William L. Miller
*Attorney, Agent, or Firm*—Brady, O'Boyle & Gates

[57] ABSTRACT

A safety cushion provided by folding a tread portion of a discarded tire back onto itself. Fasteners can be employed for maintaining the tread portion in the folded position. The safety cushion can be placed between and underneath shipping crates, underneath hold-down straps for the shipping crates, or contained in conventional cylindrical containers employed as road abutments. A plurality of safety cushions can be contained in a holding frame assembly, or interconnected by a cable network to provide an impact device. A plurality of the impact devices can be positioned at the end of a guard rail, or connected end to end to provide an impact-absorbing retaining wall.

8 Claims, 4 Drawing Sheets

SAFETY CUSHION

BACKGROUND OF THE INVENTION

In applicant's pending patent application Ser. No. 08/442,504 filed May 16, 1995, the disclosure of which is incorporated herein by reference, there is disclosed an impact-absorbing device employing a plurality of nested annular tread portions of discarded tires constructed and arranged to be either positioned at the end of a guard rail or wall to provide an impact-absorbing abutment, or to form a wall or fence, or to be inserted into conventional road abutment containers. In his continuing research and experimentation to find new uses for the tread portions of discarded tires, the safety cushion of the present invention has been devised.

SUMMARY OF THE INVENTION

The safety cushion of the present invention comprises, essentially, a discarded sidewall-less tire annular tread portion having a continuous transversely and circumferentially extending tread path. The annular tread portion is folded or reversely bent into itself to provide a C-shaped member having an entrant portion, an outer wall, and an inner wall spaced inwardly from the outer wall, the inner wall being connected to the outer wall at the entrant portion. The annular tread portion can be further folded back into itself from the C-shaped configuration to form a convolution, and in another embodiment the annular tread portion is cut to provide a tread portion strip rolled or folded back on itself to form a coil or convolution. The folded tread portion can be held in the folded position by various fasteners, such as a bolt assembly extending through the folded tread portion, or by a tape extending around the outer peripheral surface of the outer wall. The safety cushion of the present invention can be employed for supporting cargo while being shipped, as a cushion placed between cargo and binding straps, or placed in a conventional cylindrical plastic container, or a holding frame assembly employed as a road abutment. As disclosed in the aforementioned pending application, a network of cables can interconnect a plurality of the safety cushions to provide an impact device positioned at the end of a guard rail wherein one end of the impact device is connected to the guard rail, and the opposite end is connected to the ground. A plurality of the impact devices can also be connected end-to-end to provide an impact-absorbing retaining wall.

DESCRIPTION OF THE PREFERRED EMBODIMENTS

Figure 1:
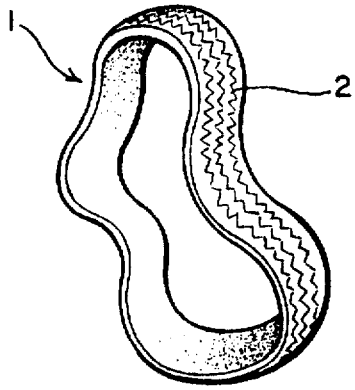
FIG. 1 is a perspective view of an annular tread portion of a discarded tire.

Referring to the drawings and, more particularly to FIG. 1, there is illustrated a discarded, sidewall-less tire annular tread portion 1 having a continuous transversely and circumferentially extending tread path 2.

Figure 2:
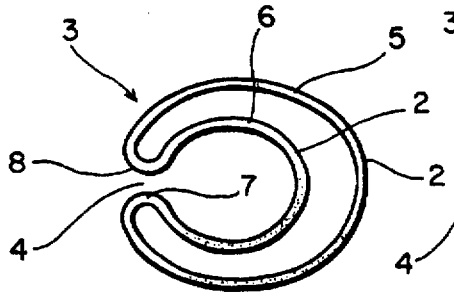
FIG. 2 is a side elevational view of the tire tread portion folded back on itself to form the safety cushion of the present invention.

As will be seen in FIG. 2, the safety cushion 3 of the present invention is obtained by folding or bending the tire tread portion 1 back into itself to form a C-shaped member having an entrant portion 4, an outer wall 5, and an inner wall 6 spaced inwardly from the outer wall 5, the outer and inner walls 5, 6 being connected by the bend portions 7 and 8 at the entrant portion 4.

Figure 5:
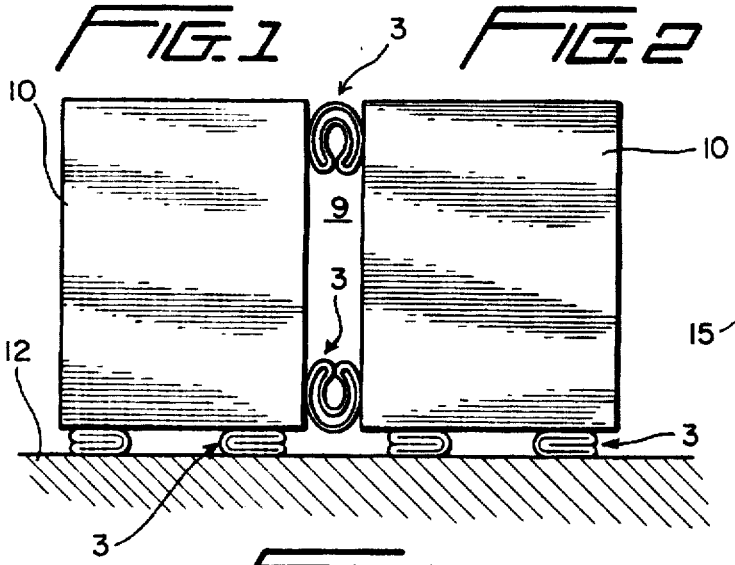
FIG. 5 is a side elevational view of a plurality of the safety cushions shown in FIG. 2 positioned between and underneath shipping crates.
Figure 7:
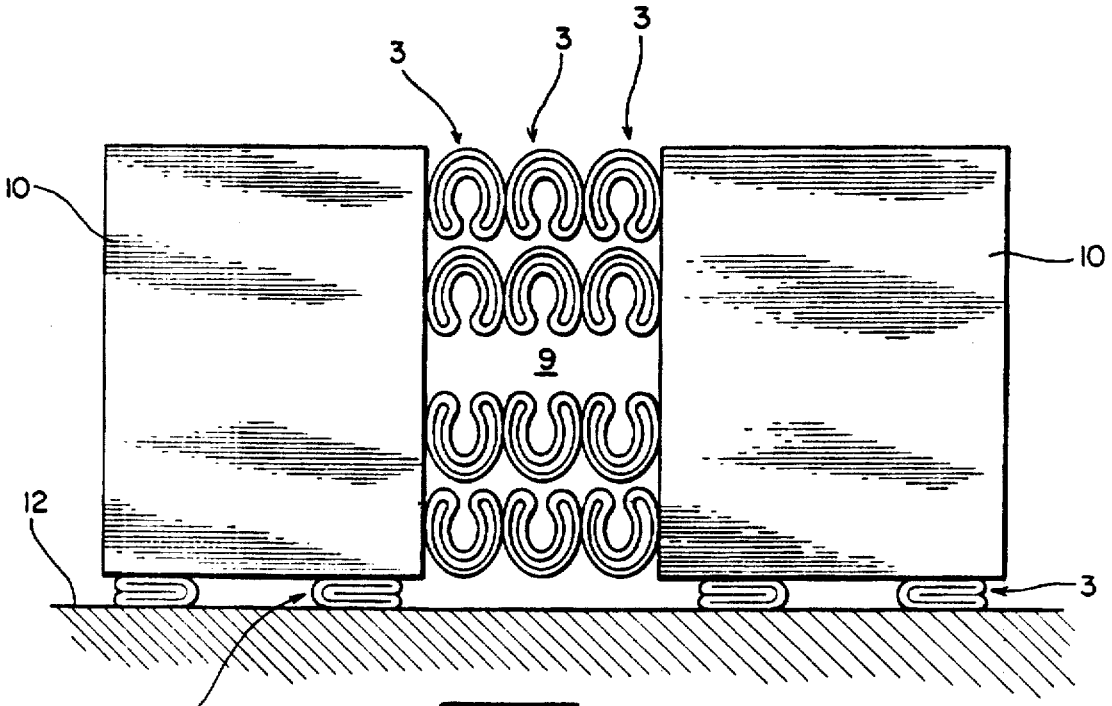
FIG. 7 is a side elevational view similar to FIG. 5 but illustrating a plurality of the safety cushions in abutting relationship with each other and positioned between shipping crates.
Figure 8:
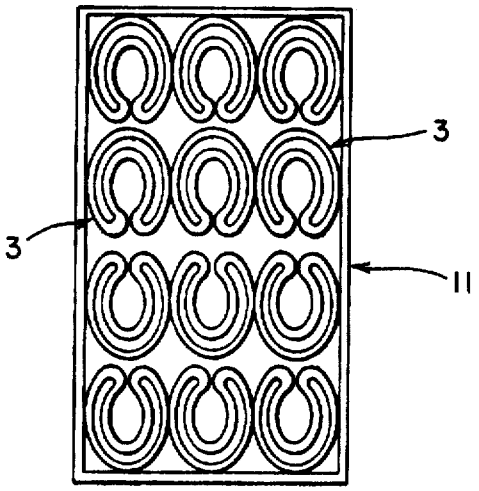
FIG. 8 is a side elevational view of a conventional cylindrical plastic container employed as a road abutment containing a plurality of the safety cushion.
Figure 9:
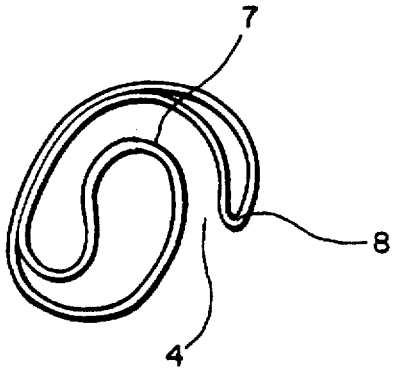
FIG. 9 is a side elevational view of the tire tread portion shown in FIG. 2 folded further back into itself to form a convolution.

FIGS. 5, 7, and 8 illustrate various uses of the safety cushion 3. In FIGS. 5 and 7, a plurality of the safety cushions 3 are positioned in the space 9 between shipping crates 10. While FIG. 5 illustrates a cushioning device 3 positioned between and abutting end walls of the crates 10, FIG. 7 shows a plurality of the safety cushion 3 in abutting relationship with each other and the end walls of the shipping crates 10. In FIG. 8, a plurality of the safety cushions 3 are placed in a conventional cylindrical plastic container 11 employed as a road abutment.

Figure 6:
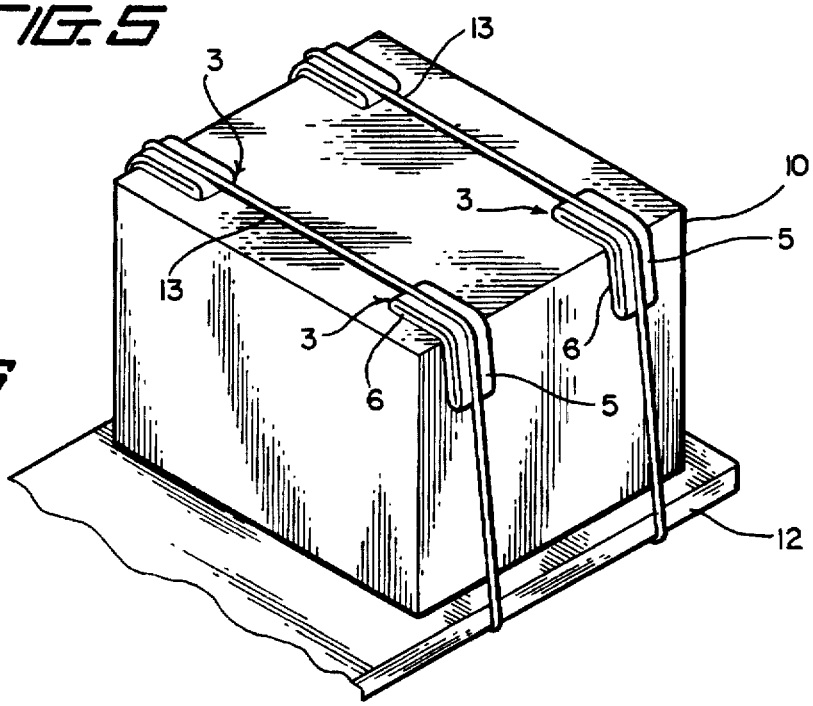
FIG. 6 is a perspective view of a plurality of the safety cushions shown in FIG. 2 positioned between a shipping crate and hold-down straps.

As will be seen in FIGS. 5 and 7, the safety cushion 3 can also be positioned underneath the shipping crates 10 for supporting the crates on a supporting surface 12, and in FIG. 6 the safety cushion 3 is shown positioned between the shipping crate 10 and hold-down straps 13. In each of these instances, it is to be understood that the initial configuration of the safety cushion 3 is that shown in FIG. 2 and, depending upon what use the safety cushion 3 is put, it will either remain in the initial configuration when placed between the shipping crates 10, or become flattened when placed underneath the shipping crates 10 as shown in FIGS. 5 and 7. Furthermore, when employed as a safety cushion between the shipping crate 10 and hold-down straps 13 as shown in FIG. 6, the C-shaped member is spread outwardly and the outer and inner walls 5 and 6 are in abutting relationship.

Figure 3:
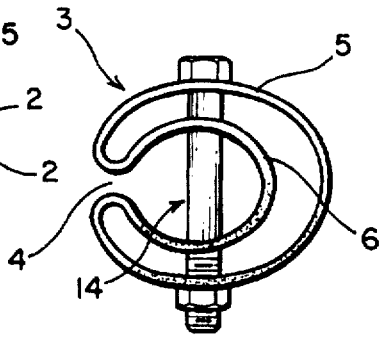
FIG. 3 is a side elevational view of the folded tire tread portion of FIG. 2 held in the folded position by a bolt assembly.
Figure 4:
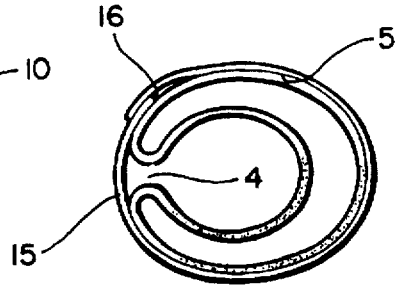
FIG. 4 is a side elevational view of the folded tire tread portion of FIG. 2 held in the folded position by a tape.

In some instances, it is desirable to prevent the folded annular tire tread portion from spreading radially outwardly to the unfolded position. To this end, FIG. 3 illustrates the use of a bolt assembly 14 extending through the outer and inner walls 5 and 6 of the folded tread portion. In lieu of the bolt assembly 14 of FIG. 3, FIG. 4 shares the use of a band or tape 15 extending around the outer peripheral surface of the outer wall 5, the ends of the tape being fastened together as at 16.

Figure 10:
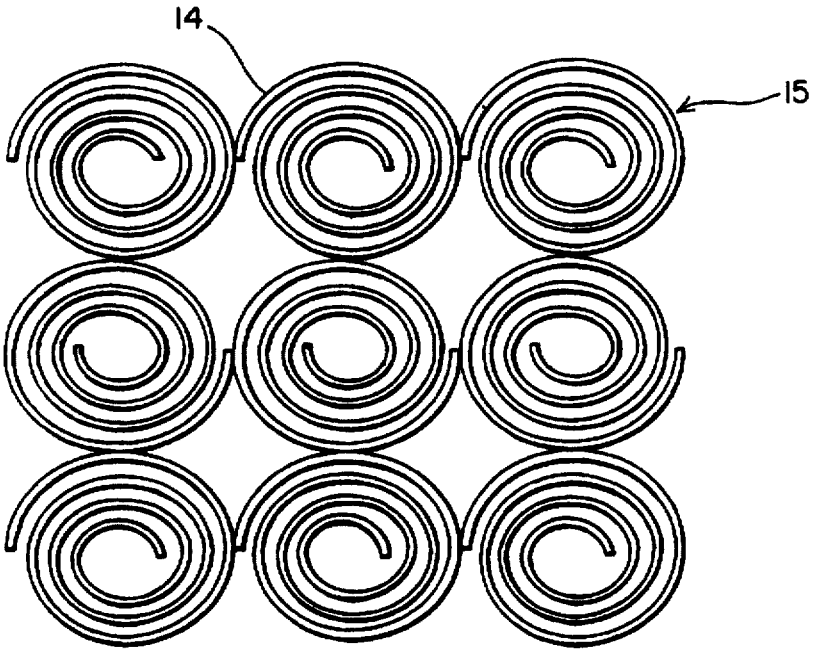
FIG. 10 is a side elevational view of a plurality of tire tread strips rolled up to form a coil.
Figure 11:
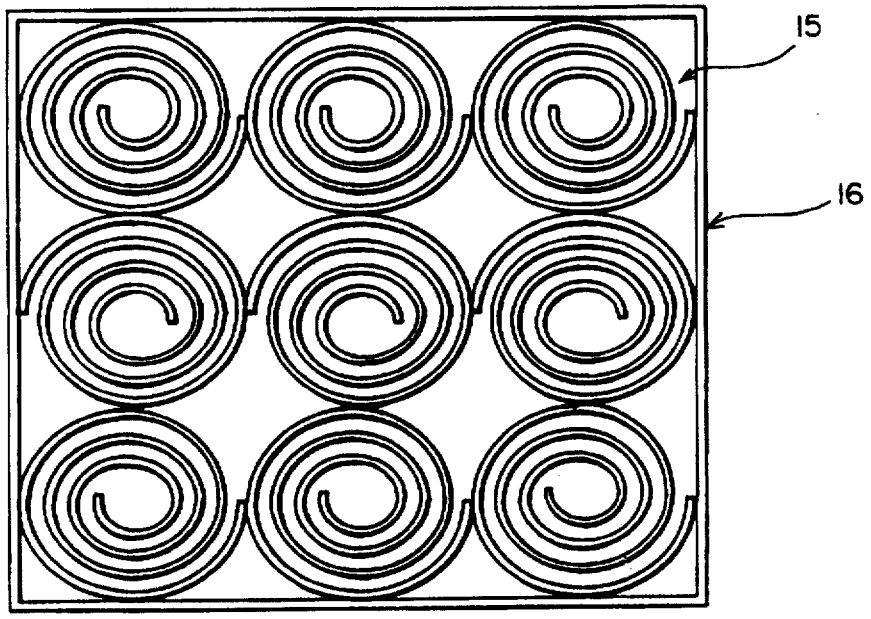
FIG. 11 is a top plan view of a plurality of coiled tire tread strips contained within a frame assembly to form an impact device.
Figure 12:
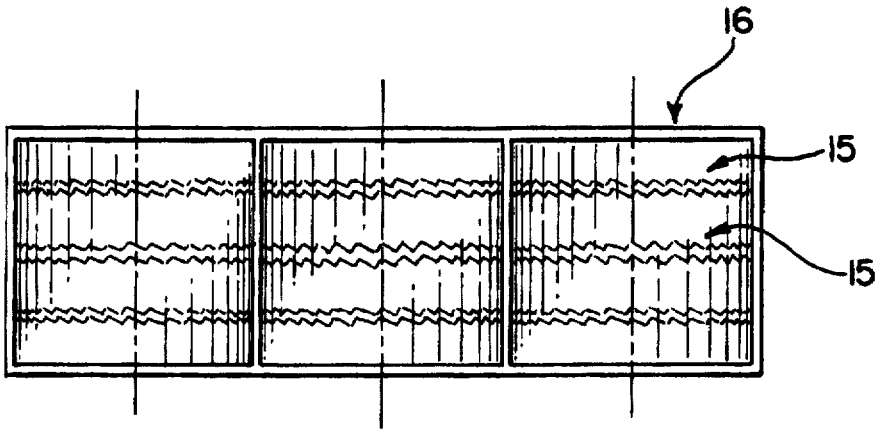
FIG. 12 is a side elevational view of the impact device of FIG. 11.

FIG. 10 discloses another embodiment of the safety cushion of the present invention wherein the annular tread portion 1 of FIG. 1 is cut to provide a tread portion strip 14 rolled or folded back on itself to form a coil or convolution 15. A suitable fastener, such as tape, can be employed for holding the strip 14 in the coiled configuration. A plurality of the convolutions 15 can be stacked as shown and positioned between shipping crates in a manner shown in the embodiment of FIG. 7, or placed in a road abutment container in a manner shown in the embodiment of FIG. 8.

In lieu of the road abutment container 11 shown in FIG. 8, a holding frame assembly 16 can be provided for containing the plurality of stacked convolutions 15.

Figure 13:
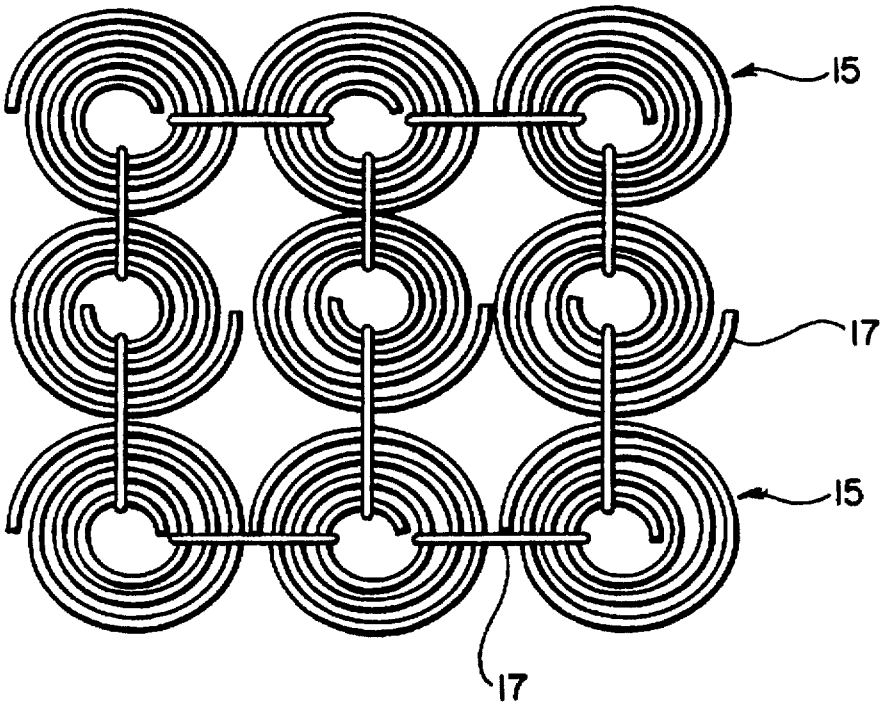
FIG. 13 is a top plan view of a plurality of coiled tire tread strips interconnected by a cable network.

As will be seen in FIG. 13, a network of cables 17 can interconnect the plurality of stacked convolutions 15 to provide an impact device positioned at the end of a guard rail as shown and described in applicant's aforementioned pending application, wherein one end of the impact device is connected to the guard rail and the opposite end is connected to the ground. Furthermore, a plurality of the impact devices can be connected end to end to provide an impact-absorbing retaining wall, as disclosed in the above-noted pending application.

From the above description, it will be appreciated by those skilled in the art that applicant has provided further uses for the annular tread portions of discarded tires by employing the tire tread portions as an impact-absorbing device as disclosed in the aforementioned patent and, now, by folding the tire tread portions and employing the folded tire tread portion as a safety cushion.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A safety cushion comprising a discarded sidewall-less circumferentially continuous, annular tire tread portion, said annular tire tread portion being folded back onto itself to provide an entrant portion, an outer wall, an inner wall, said inner wall being spaced inwardly from said outer wall, said entrant portion having a width less than the distance between the opposing sides of said inner wall, bend portions at said entrant portion connecting the inner wall with said outer wall, and means for holding the annular tire tread portion in the folded position.

2. A safety cushion according to claim 1, wherein the annular tire tread portion is folded back on itself to form a C-shaped configuration, said bend portions being at said entrant portion.

3. A safety cushion according to claim 1, wherein the annular tire tread portion is folded back onto itself to form a convolution, said bend portions being in overlapped relationship, whereby one bend portion is spaced radially inwardly from another bend portion.

4. The safety cushion according to claim 2, wherein the means for holding the annular tire tread portion in the folded position comprises a bolt assembly extending through the outer and inner walls of the C-shaped configuration.

5. The safety cushion according to claim 1, wherein the means for holding the annular tire tread portion in the folded position comprises a band extending around the outer peripheral surface of the outer wall.

6. The combination of a safety cushion and at least one pair of shipping crates, said safety cushion, comprising a discarded sidewall-less circumferentially continuous annular tire tread portion, said annular tire tread portion being folded back onto itself to provide an entrant portion, an outer wall, an inner wall, said inner wall being spaced inwardly from said outer wall, said entrant portion having a width less than the distance between the opposing sides of said inner wall, and bend portions at said entrant portion connecting the inner wall with said outer wall, at least one of said safety cushions being positioned between said at least one pair of shipping crates and in abutting relationship therewith.

7. The safety cushion according to claim 6, wherein a plurality of said safety cushions are positioned between said at least one pair of shipping crates and are in abutting relationship therewith and with each other.

8. The combination of a safety cushion and a conventional cylindrical container employed as a road abutment, said safety cushion comprising a discarded sidewall-less circumferentially continuous annular tire tread portion, said annular tire tread portion being folded back onto itself to provide an entrant portion, an outer wall, an inner wall, said inner wall being spaced inwardly from said outer wall, said entrant portion having a width less than the distance between the opposing sides of said inner wall, and bend portions at said entrant portion connecting the inner wall with said outer wall, at least one of said safety cushions being placed within said cylindrical container.

* * * * *